United States Patent [19]

Walkden

[11] Patent Number: 4,927,496

[45] Date of Patent: May 22, 1990

[54] SIZING PULP

[75] Inventor: Stephen A. Walkden, Newark, Del.

[73] Assignee: Hercules Incorporated, Wilmington, Del.

[21] Appl. No.: 198,522

[22] Filed: May 25, 1988

[30] Foreign Application Priority Data

May 26, 1987 [GB] United Kingdom ..... 8712349

[51] Int. Cl.[5] ..... D21H 3/02

[52] U.S. Cl. ..... 162/136; 162/158; 162/180; 162/194; 229/3.1

[58] Field of Search ..... 162/158, 180, 135, 127, 162/136, 194; 229/3.1; 427/331, 391

[56] References Cited

U.S. PATENT DOCUMENTS 4,522,686 6/1985 Dumas ..... 162/180

*Primary Examiner*—Peter Chin

*Attorney, Agent, or Firm*—Ivan G. Szanto

[57] ABSTRACT

Increased resistance of the cut edges of liquid packaging board to penetration by hot hydrogen peroxide is obtained by adding an aqueous emulsion of ketene dimer, cationic rosin size and insolubilizing agent either separately or in preblended form to the aqueous pulp slurry at a neutral to alkaline pH.

18 Claims, No Drawings

SIZING PULP

BACKGROUND OF THE INVENTION

1. Field of the Invention

The present invention relates to the sizing of pulp for use in producing liquid packaging board and more particularly it relates to the use of alkyl ketone dimer, cationic rosin size and insolubilizing agent at neutral or alkaline pH in producing liquid packaging board having outstanding resistance to edge penetration by hot hydrogen peroxide.

2. Description of the Prior Art

In recent years there has been a trend towards packaging liquid products, and in particular liquid dairy products such as milk and cream, in containers made out of coated paper-based board. The coating may be on one side of the board, but is generally on both sides. The coating is generally of polyethylene, although other substances are used.

In order to be able to function effectively in such a container, the board must be resistant to the effects of the liquid. For liquid dairy products, the most aggressive component of the liquid is generally lactic acid. The most vulnerable area of the board tends to be its cut edge.

Board manufacturers have therefore investigated ways to improve the resistance of board to edge penetration by lactic acid-containing liquids. It is known that board sized with a ketone dimer (KD) has good resistance to edge penetration by lactic acid-containing liquids.

More recently, there has been a trend towards aseptic packaging of consumable liquids and in particular liquid dairy products. In order to carry out aseptic packaging, it is necessary to sterilize the package as well as its contents. It has been proposed that containers made out of board should be sterilized by use of hydrogen peroxide solutions at elevated temperatures. It has been found that board sized with a KD has low resistance to edge penetration by hot hydrogen peroxide containing solutions. There is therefore a need for a board which has good resistance to edge penetration by such hot solutions of hydrogen peroxide, and particularly by liquids containing lactic acid following contact with hot hydrogen peroxide.

It has been shown that board sized with a cationic rosin size (CRS) or with a conventional anionic rosin size (emulsion, paste or soap) has good resistance to edge penetration by hot hydrogen peroxide containing liquids, but low resistance to edge penetration by lactic acid containing liquids.

It is well known in the art that sizing with KD's must be carried out at neutral or slightly alkaline pH's (between 7 and 8.5) in order to achieve effective sizing. Moreover, sizing with KD's can be adversely affected by the presence of some cations, such as aluminum cations.

It is also well known in the art that, in order to be effective, sizing with CRS must be carried out at acidic pH's between 4 and 6, and sizing with conventional rosin sizes must be carried out at acidic pH's between 4 and 5. Further, both sizes require the presence of an insolubilizing agent (i.e. a compound which forms an insoluble complex or salt with the size). The most commonly used insolubilizing agent is alum ($A12(S04)3$).

U.S. Pat. No. 4,522,686 discloses a sizing composition in the form of an aqueous dispersion containing a hydrophobic cellulose reactive sizing agent, such as a KD, fortified rosin and a water-soluble, nitrogen containing cationic dispersing agent, the last two components forming the elements of a CRS. As shown in the Examples of this patent, the dispersion is made by producing a KD emulsion using a cationic resin. A cationic emulsion of fortified rosin is then also prepared. The final dispersion is made by mixing the two emulsions in various ratios. The final dispersion is then used, with or without the addition of alum, to produce sized paper from a pulp at a pH of about 6.5. The patent shows that using such a cationic dispersion results in improved sizing measured, using the Hercules Size Test solution No. 2 to 80% reflectance. This measures the surface sizing of the paper. However, there is no suggestion that there is a particular problem caused by sterilization by hydrogen peroxide, nor is there any indication that the sizing using the combined cationic dispersion has any effect on resistance to edge penetration by hydrogen peroxide containing liquids nor by liquids containing lactic acid following contact with hot hydrogen peroxide solutions.

There is no known correlation between surface sizing and edge penetration resistance—good surface sizing does not ensure good edge penetration resistance. Further the measurement of effects of aggressive liquids such as hot hydrogen peroxide containing liquids and lactic acid can give very different results depending on the tests used for such measurements.

In fact, as shown by the introduction to the said U.S. patent, the object of the invention is not only to improve sizing per se but to overcome several of the well known disadvantages associated with either the cellulose reactive sizing agent or the cationic rosin size alone, and particularly to improve the rate at which sizing develops. If sizing develops quickly, newly formed paper is able to run more quickly through the machine, and in particular through the sizing press, which is clearly advantageous from an operational viewpoint for the production of paper, but has no relevance to the production of paper board in the absence of a sizing press, and its properties in use.

SUMMARY OF THE INVENTION

According to the present invention, an emulsion of an alkyl ketone dimer size in conjunction with a cationic rosin size and an insolubilizing agent is used for increasing the resistance of the cut edges of liquid packaging board to penetration by hot hydrogen peroxide by adding both sizes and the insolubilizing agent either separately or in preblended form to the aqueous pulp slurry at a neutral to alkaline pH in a machine for producing the liquid packaging board.

DETAILED DESCRIPTION OF THE INVENTION

It has surprisingly been found that if a ketone dimer and a cationic rosin size are added, together with an insolubilizing agent, to a pulp slurry at neutral to alkaline pH and the pulp is then formed into board, the board has good resistance to edge penetration by liquids containing hydrogen peroxide or lactic acid or both.

Moreover, it has been found that the resistance of the boards in both respects is unexpectedly better than would be predicted by adding together the effects of the two sizes when used separately.

Although it is preferred to add the components separately, the same surprising results are given by preblending the KD and the CRS before addition to the pulp slurry.

This surprising effect is even more unexpected since it was found that the use of a KD and an anionic rosin size did not give the same sizing effects. This combination gives moderate resistance to edge penetration by hot hydrogen peroxide but has an adverse effect on edge penetration by lactic acid.

In the absence of preblending the KD, the CRS and the insolubilizing agent may be added separately but simultaneously to the pulp slurry, advantageously immediately before the slurry is fed to a board forming machine. However, the components may alternatively be added sequentially and in any desired order. The order of addition of the KD and the CRS is not critical. It is only necessary to ensure that the pulp remains in an aqueous environment at neutral to alkaline pH at all times between the addition of the two sizing agents.

Preferably, the CRS and insolubilizing agent are added to the vessel in which the slurry is initially formed and the KD is added immediately before the slurry is fed to the forming machine.

Advantageously, the CRS and the insolubilizing agent are mixed together prior to the mixture being added to the slurry. However, the insolubilizing agent may be added separately at any stage during the processing of the slurry either before or after the addition of the CRS.

It is envisaged that the pulp, once treated with the three components, will be formed into board for use in aseptic packaging of liquids. However, the invention is not limited to such use, and the pulp may be formed into any desired product. Any conventional forming machine may be used.

Any of the KD's known in the art may be used in the process of the present invention at the levels generally used in sizing. For instance, the final pulp slurry may contain from about 0.01 to about 0.6% KD [based on the dry weight of the pulp (db)]. Preferably, the final slurry contains about 0.12% db of KD.

Ketene dimers used as sizing agents are dimers having the formula:

$$[R—CH=C=O]2$$

where R is a hydrocarbon radical, such as alkyl having at least 8 carbon atoms, cycloalkyl having at least 6 carbon atoms, aryl, aralkyl and alkaryl. In naming ketene dimers, the radical "R" is named followed by "ketene dimer". Thus decyl ketene dimer is [C10H21—CH=C=O]2. Examples of ketene dimers include octyl, decyl, dodecyl, tetradecyl, hexadecyl, octadecyl, eicosyl, docosyl, tetracosyl, phenyl, benzyl, beta-napthyl and cyclohexyl ketene dimers and the ketene dimers prepared by known methods from organic acids such as montanic acid, naphthenic acid Δ9,10-decylenic acid, Δ9,10-dodecylenic acid, palmitoleic acid, oleic acid, ricinoleic acid, linoleic acid, and eleostearic acid, and from naturally occurring mixtures of fatty acids, such as those mixtures found in coconut oil, babassu oil, palm kernel oil, palm oil, olive oil, peanut oil, rape oil, beef tallow, lard (leaf) and whale blubber. Mixtures of any of the above-named fatty acids with each other may also be used. Suitable KD's are disclosed in U.S. Pat. No. 4,279,794 and United Kingdom Patent Nos. 786,543; 903,416; 1,373,788 and 1,533,434.

Preferred KD's are prepared from palmitoleic acid or eleostearic acid or from mixtures of these acids.

Any of the CRS's known in the art may be used in the process of the present invention at the levels generally used in sizing. For instance, the final pulp slurry may contain from about 0.4 to about 4.0% db of an alum containing CRS. Preferably, the final slurry contains about 1% of an alum containing CRS.

A preferred type of CRS is a fortified rosin in a liquid cationic dispersing agent such as polyamide cationic resin. CRS's of this type are disclosed in U.S. Pat. No. 3,817,768, U.S. Pat. No. 3,966,654 and U.S. Pat. No. 4,199,369.

The insolubilizing agent may be any one of those known in the art, and is preferably alum. Preferably, the amount used is approximately the same as that normally used with CRS's. Generally, the amount of insolubilizing agent used will be from about 0.5 to about 2.0, preferably from about 1 to about 1.5, parts per part of the rosin component.

The process of making a container for consumable liquids generally includes the steps of forming paper board from a pulp slurry at neutral to alkaline pH, cutting the board to unit size and thereby exposing cut edges of the board, coating the board with polyethylene, treating it with a hot aqueous solution of hydrogen peroxide and forming the final packaging unit.

The pulp slurry may be processed in any conventional manner before the pulp is formed, for instance into a board for aseptic packaging use, and any other conventional additives, such as flocculating agents, pigments and fillers, may be added as desired.

The present invention also includes products, such as boards, made from pulp treated by the process of the present invention.

The following examples are given for the purpose of illustrating the present invention. All parts and percentages are by weight unless otherwise indicated.

EXAMPLES 1-2 AND COMPARATIVE EXAMPLES C-1 to C-5

A number of samples of paper-based board for use in aseptic packaging of dairy products were prepared. The original pulp was formed into a slurry and treated in a conventional system before being fed to a conventional board forming machine.

Two grades of starting pulp were used, one being a woodfree pulp (WP) comprising 50% Lumi bleached softwood sulphate (25° SR) and 50% Oulu beached hardwood sulphate (25° SR). The second grade had added high yield pulp (+HYP) and comprised 40% Lumi (as above), 40% Oulu (as above) and 20% Rockhammer high yield pulp.

The pulp slurry was initially adjusted to a desired pH and then the sizing agents were added immediately prior to feeding the treated slurry to the forming machine.

Once the board had been formed it was subjected to the following tests.

A. Cobb Test.—1 minute water Cobb test, to test for surface sizing. The results are given as grams of water absorbed per square meter (g/m2)

B. 24hr. lactic edge penetration.—Samples of board were laminated on both sides with a polyester film using a hot melt adhesive. 50×50 mm samples were immersed in a 1% solution of lactic acid at 23° C. for 24 hours.

After immersion the samples were removed, dried by blotting and reweighed. The results are given as grams of solution absorbed per meter of raw edge (g/m).

C. 10 min. lactic edge penetration—The test procedure was as for Test 2 above, except that self-adhesive tape was used instead of polyester film, the solution comprised 1% lactic acid held at 70° C., and the immersion time was 10 minutes.

D. 10 min peroxide edge penetration—The test procedure was as for Test 3 above, except that the solution comprised 30% hydrogen peroxide at 80° C.

It will be appreciated that in all these tests good sizing will give a lower value than poor sizing. For the Cobb test, good sizing values are about 20 and poor sizing values are in excess of 40.

The conditions and additives used to produce the boards are given in Table I and the results of the tests are given in Table II below. In Table I the amounts of additives used are given as % db.

The ketene dimer (KD) was Aquapel® 360X, an alkyl ketene dimer having a mixture of C14 and C16 alkyl chains in an aqueous emulsion containing a cationic waxymaize starch derivative, sold by Hercules Incorporated.

The cationic rosin size contained fortified rosin, an aluminum compound (alum) and 15% polyamide cationic resin (based on the weight of the rosin), sold by Hercules Limited under the trademark HERCAT. The amount of alum present is one part per part of the rosin component.

TABLE I

| TESTS | SLURRY pH | KD | CRS +ALUM | PULP |
|---|---|---|---|---|
| C-1 | 4.5 | | 1 | WF |
| C-2 | 7.5 | — | 1 | WF |
| C-3 | 7.5 | 0.12 | — | WF |
| 1 | 7.5 | 0.12 | 1 | WF |
| C-4 | 7.5 | 0.12 | — | +HYP |
| C-5 | 7.5 | — | 1 | +HYP |
| 2 | 7.5 | 0.12 | 1 | +HYP |

TABLE II

| EXAMPLE | Test Results A | B | C | D |
|---|---|---|---|---|
| C-1 | 23.5 | 3.08 | 0.50 | 0.27 |
| C-2 | 41.8 | 1.73 | 2.78 | 1.24 |
| C-3 | 17.0 | 0.32 | 1.32 | 0.41 |
| 1 | 18.3 | 0.33 | 0.52 | 0.22 |
| C-4 | 19.6 | 0.48 | 0.17 | 1.32 |
| C-5 | * | 2.06 | 2.34 | 2.78 |
| 2 | 19.2 | 0.50 | 0.25 | 0.52 |

*indicates that water penetrated the sample during testing.

It can be seen from Comparative Example C-1 that board sized with either CRS or anionic rosin size at acid pH has low lactic acid resistance, but high peroxide resistance. However, when CRS is applied at neutral pH, it provides no useful sizing or penetration resistance (see Comparative Examples C-2 and C-5).

Comparative Examples C-3 and C-4 show that sizing with KD at neutral pH provides good lactic resistance but low peroxide resistance.

Examples 1 and 2 show that sizing with KD and CRS provides not only good lactic and peroxide resistance, which is in itself unexpected, but also better results than could be expected from a consideration of the results for the two components used alone. It is to be noted that for WF pulps, the peroxide resistance for Example 1 is better than any of the others. Moreover, in all cases, the 24hr. lactic and 10 min. lactic test results are equivalent to those obtained for the separate components. It is surprising that such good results can be obtained from a system which would be expected to have compatibility problems.

EXAMPLES 3 TO 9 AND COMPARATIVE EXAMPLES C-6 TO C-18

A further series of examples was carried out on a pilot paper machine using a slightly different pulp furnish as follows:

40% Rockhammer CTMP
30% Modo Kraft
30% Oulu birch

All chemical additions were made to the mixing box i.e. after the machine refiner but before the headbox. Where "separate" addition of alum is shown, then both size and alum were added as dilute emulsions via a funnel.

The results reported in Tables III, IV and V were the averages obtained from identical triplicate samples.

Table III shows that four different anionic sizes gave the same results, namely:

All improved the hot peroxide edge resistance but not as efficiently as the CRS.

All had an adverse effect on cold lactic acid edge resistance.

Table IV shows the effect of the following CRS's:

A CRS containing alum as described in Examples 1 and 2.

A CRS containing alum but with a different liquid cationic dispersing agent than above.

A CRS not containing alum—alum was added separately.

A CRS containing alum blended with Aquapel® 360X.

A CRS not containing alum blended with Aquapel® 360X and alum added.

Table IV shows that all cationic sizes had either no effect or a slightly beneficial effect on lactic acid edge resistance and that they all had a beneficial effect on hot hydrogen peroxide edge resistance.

Table V shows the results obtained with two different Hercules anionic sizes added separately from KD, mixed with KD, and mixed with KD and alum. The results show that all combinations with anionic rosin size had adverse effects on cold lactic acid edge resistance and gave variable results on hot hydrogen peroxide edge resistance but all were inferior to the CRS.

It will be appreciated that the invention has been described above purely by way of illustration and that modifications of detail can be made within the scope of the invention. For instance, the KD may be dispersed in a liquid cationic dispersing agent with a composition that is well known in the paper industry. Alternatively, the KD may be dispersed directly in the CRS to make a composition useful in his invention.

TABLE III

| Example | KD Size db | Rosin size db | | Alum db | Raw edge penetration 24 hr. Lactic | Raw edge penetration 10 min. $H_2O_2$ @ 70° C. | Cobb naturally aged | Sheet weight g/m$^2$ |
|---|---|---|---|---|---|---|---|---|
| C-6 | 0.12% | — | | — | 0.86 | 1.74 | 24.3 | 162.3 |
| 3 | 0.12% | Hercules CRS containing alum(1) | 1.0% | — | 0.98 | 0.33 | 21.5 | 162.7 |
| C-7 | 0.12% | Hercules anionic size(2) | 0.5% | 0.5% | 1.33 | 0.45 | 21.4 | 166.0 |
| C-8 | 0.12% | Competitive anionic size(3) | 0.5% | 0.5% | 1.24 | 0.54 | 22.6 | 165.3 |
| C-9 | 0.12% | Competitive anionic size(4) | 1.0% | 0.5% | 1.22 | 0.38 | 21.7 | 166.4 |
| C-10 | 0.12% | Competitive anionic size(5) | 1.0% | 0.5% | 1.35 | 0.42 | 21.3 | 164.9 |

(1)Cationic rosin size used in Examples 1 and 2
(2)NEUPHORB 635 anionic rosin size containing fortified rosin stabilized with casein, sold by Hercules Incorporated.
(3)BUMAL 443 anionic rosin size containing fortified rosin stabilized with casein, sold by Tenneco Inc.
(4)KENTOSOL D 400 anionic rosin size containing fortified rosin stabilized with casein, sold by Bruhl GmbH.
(5)MARECOLL EC anionic rosin size containing fortified rosin stabilized with casein, sold by Mare Spa.

TABLE IV

| Example | KD Size db | Rosin size db | | Alum db | Raw edge penetration 24 hr. Lactic | Raw edge penetration 10 min. $H_2O_2$ @ 70° C. | Cobb naturally aged | Sheet weight g/m$^2$ |
|---|---|---|---|---|---|---|---|---|
| C-11 | 0.12% | — | | — | 1.58 | 3.62 | 22.2 | 168.6 |
| 4 | 0.12% | Hercules CRS containing alum(1) | 1.0% | — | 1.10 | 0.45 | 20.3 | 171.8 |
| 5 | 0.12% | Hercules CRS containing alum(6) | 1.0% | — | 1.54 | 0.61 | 19.7 | 170.1 |
| 6 | 0.12% | Hercules CRS(7) | 0.5% | 0.5% | 1.44 | 0.61 | 19.8 | 169.9 |
| 7 | [0.12% | Hercules CRS containing alum(1) | 1.0%](*) | — | 1.16 | 0.44 | 20.4 | 167.3 |
| 8 | [0.12% | Hercules CRS(7) | 0.5% | 0.5%] | 1.27 | 0.56 | 20.3 | 167.5 |

(*)Brackets ([ ]) denote preblending of the components before addition.
(6)Cationic rosin size containing fortified rosin size stabilized with a cationic resin based on BHMT (CRS contains one part alum per part of rosin).
(7)Cationic rosin size used in Examples 1 and 2 but without alum.

TABLE V

| Example | KD Size db | Rosin size db | | Alum db | Raw edge penetration 24 hr. Lactic | Raw edge penetration 10 min. $H_2O_2$ @ 70° C. | Cobb naturally aged | Sheet weight g/m$^2$ |
|---|---|---|---|---|---|---|---|---|
| C-12 | 0.12% | — | | — | 0.86 | 2.40 | 24.5 | 166.0 |
| C-13 | 0.12% | Hercules anionic size(2) | 0.5% | 0.5 | 1.35 | 0.44 | 22.4 | 166.5 |
| C-14 | [0.12% | Hercules anionic size(2) | 0.5%](*) | 0.5 | 2.97 | 3.13 | 28.0 | 164.6 |
| C-15 | [0.12% | Hercules anionic size(2) | 0.5% | 0.5%] | 2.67 | 2.09 | 23.2 | 165.8 |
| C-16 | 0.12% | Hercules anionic size(8) | 0.5% | 0.5 | 1.45 | 0.56 | 21.4 | 168.0 |
| C-17 | [0.12% | Hercules anionic size(8) | 0.5%] | 0.5% | 1.82 | 0.67 | 23.9 | 164.5 |
| C-18 | [0.12% | Hercules anionic size(2) | 0.5% | 0.5%] | 2.65 | 1.83 | 22.4 | 165.5 |
| 9 | 0.12 | Hercules CRS containing | 1.0% | — | 0.79 | 0.29 | 20.6 | 164.0 |

TABLE V-continued

| Example | KD Size db | Rosin size db alum[1] | Alum db | Raw edge penetration 24 hr. Lactic | Raw edge penetration 10 min. $H_2O_2$ @ 70° C. | Cobb naturally aged | Sheet weight g/m$^2$ |
|---|---|---|---|---|---|---|---|

(*)Brackets ([ ]) denote preblending of the components before addition. Combination containing anionic rosin size and alum were unstable.
[8]T Lim 7635 anionic rosin size containing fortified rosin size stabilized with synthetic surfactant.

What I claim and desire to protect by Letters Patent is:

1. The process of using an aqueous emulsion of from about 0.01 to about 0.6 percent, based on the dry weight of the pulp, of ketene dimer size, from about 0.4 to about 4 percent, based on the dry weight of the pulp, of cationic rosin size and insolubilizing agent, for increasing the resistance of the cut edges of liquid packaging board to penetration by hot hydrogen peroxide, said process comprising adding both sizes and the insolubilizing agent either separately or in preblended form to the aqueous pulp slurry at a pH of at least about 7.0.

2. The process of claim 1 wherein the insolubilizing agent is present in an amount of from about 0.5 to about 2 parts per part of cationic rosin.

3. The process of claim 1 wherein the ketene dimer has the formula:

$$[R—CH=C=O]_2$$

where R is a hydrocarbon radical.

4. The process of claim 3 wherein the hydrocarbon radical of the ketene dimer is selected from the group consisting of alkyl having at least 6 C atoms, cycloalkyl having at least 6 C atoms, aryl having at least 6 C atoms, aralkyl having at least 8 C atoms, and alkaryl having at least 10 C atoms.

5. The process of claim 4 wherein the ketene dimer is selected from the group consisting of (a) octyl, decyl, dodecyl, tetradecyl, hexadecyl, octadecyl, eicosyl, docosyl, tetracosyl, phenyl, benzyl, beta-napthyl and cyclohexyl ketene dimers and the ketene dimers prepared from organic acids selected from the group consisting of montanic acid, naphthenic acid 9,10-decylenic acid 9,10-dodecylenic acid, palmitoleic acid, oleic acid, ricinoleic acid, linoleic acid, eleostearic acids, naturally occurring mixtures of fatty acids found in coconut oil, babassu oil, palm kernel oil, palm oil, olive oil, peanut oil, rape oil, beef tallow, lard (leaf) and whale blubber, and mixtures of any of the above named fatty acids with each other.

6. The process of claim 1 wherein the cationic rosin size comprises fortified rosin in liquid cationic dispersing agent.

7. The process of claim 6 wherein the liquid cationic dispersing agent is a cationic polyamide resin.

8. The process of claim 1 wherein the insolubilizing agent is alum.

9. The process of claim 1 wherein the cationic rosin size and the insolubilizing agent are added to the vessel in which the aqueous pulp slurry is formed and the ketene dimer size is added immediately before the slurry is fed to the board forming machine.

10. The process of claim 5 wherein the ketene dimer is present in an amount of from about 0.01 to about 0.6 db, the cationic rosin size comprises fortified rosin and cationic polyamide resin and is present in an amount of from about 0.4 to about 4 percent db, the solubilizing agent is alum and is present in an amount of from about 0.5 to about 2 parts per part of cationic rosin and wherein the cationic rosin size and the insolubilizing agent are added to the vessel in which the aqueous pulp slurry is formed and the ketene dimer size is added immediately before the slurry is fed to the board forming machine.

11. The process of claim 10 wherein the ketene dimer is selected from the group consisting of ketene dimers prepared from palmitoleic acid or eleostearic acid or mixtures thereof.

12. The process of claim 10 wherein the ketene dimer is present in an amount of about 0.12 percent db.

13. The process of claim 10 wherein the cationic rosin size is present in an amount of about 1 percent db.

14. The process of claim 10 wherein the alum is present in an amount of from about 1 to about 1.5 parts per part of cationic rosin.

15. The process of claim 11 wherein the ketene dimer is present in an amount of about 0.12 percent based on the dry weight of the pulp, the cationic rosin size is present in an amount of about 1 percent db and the alum is present in an amount of from about 1 to about 1.5 parts per part of cationic rosin.

16. The process of claim 15 wherein liquid packaging board is produced from the aqueous pulp slurry, container is made of said liquid packaging board, and said container contains latic acid containing liquid.

17. In a process for making a container for consumable liquids including the steps of forming paper board from a pulp slurry at a pH of at least about 7.0, cutting the board to packaging size and thereby exposing cut edges of the board, coating the board with polyethylene, treating it with a hot aqueous solution of hydrogen peroxide and forming the final packaging unit, the improvement comprising adding to the pulp before the paper board forming step an emulsion of from about 0.01 to about 0.6 percent, based on the dry weight of the pulp, of ketene dimer size, from about 0.4 to about 4 percent, based on the dry weight of the pulp, of cationic rosin size, and insolubilizing agent.

18. In a process for making a container for consumable liquids including the steps of forming paper board from a pulp slurry at neutral to alkaline pH, cutting the board to packaging size and thereby exposing cut edges of the board, coating the board with polyethylene, treating it with a hot aqueous solution of hydrogen peroxide and forming the final packaging unit, the improvement comprising adding to the pulp before the paper board forming step the ketene dimer, cationic rosin size and insolubilizing agent according to the process of claims 5, 10, 15 or 16.

* * * * *

UNITED STATES PATENT AND TRADEMARK OFFICE

CERTIFICATE OF CORRECTION

PATENT NO. 4,927,496

DATED MAY 22, 1990

INVENTOR(S) WALKDEN 1

It is certified that error appears in the above-identified patent and that said Letters Patent is hereby corrected as shown below:

Column 1, Line 8,
Column 1, Line 30,
Column 2, Line 47,
Column 2, Line 59

"ketone" should read --ketene--

Column 9, Table V, Line 7

"Combination" should read --Combinations--

Column 9, Line 65, Claim 10,
Column 10, Line 12, Claim 10,
Column 10, Line 25, Claim 12,
Column 10, Line 27, Claim 13

"db" should read --based on the dry weight of the pulp--.

UNITED STATES PATENT AND TRADEMARK OFFICE

CERTIFICATE OF CORRECTION

PATENT NO. : 4,927,496

DATED : MAY 22, 1990

INVENTOR(S) : WALKDEN 1

It is certified that error appears in the above-identified patent and that said Letters Patent is hereby corrected as shown below:

Column 4, Line 64

"(g/m2)" should read -- $(g/m^2)$. --

Column 10, Line 40, Claim 16

"latic" should read -- lactic --.

Signed and Sealed this

Seventeenth Day of December, 1991

*Attest:*

*Attesting Officer*

HARRY F. MANBECK, JR.

*Commissioner of Patents and Trademarks*